US008096384B2

(12) United States Patent
Caylor et al.

(10) Patent No.: US 8,096,384 B2
(45) Date of Patent: Jan. 17, 2012

(54) SAFETY LINE ANCHOR

(75) Inventors: Gerald L. Caylor, St. Joseph, MO (US); Brian M. Schubert, St. Joseph, MO (US)

(73) Assignee: Herzog Contracting Corp., St. Joseph, MO (US)

( * ) Notice: Subject to any disclaimer, the term of this patent is extended or adjusted under 35 U.S.C. 154(b) by 483 days.

(21) Appl. No.: 12/333,001

(22) Filed: Dec. 11, 2008

(65) Prior Publication Data

US 2010/0147624 A1 Jun. 17, 2010

(51) Int. Cl.
*E06C 7/18* (2006.01)

(52) U.S. Cl. ..... 182/3; 248/228.5; 248/499

(58) Field of Classification Search ... 182/3; 248/228.5, 248/499

See application file for complete search history.

(56) References Cited

U.S. PATENT DOCUMENTS

| | | | | |
|---|---|---|---|---|
| 830,700 | A | 9/1906 | Birkenkamp | |
| 1,275,053 | A | 8/1918 | Leiding | |
| 1,752,522 | A * | 4/1930 | Eckelman | 248/37.6 |
| 1,891,588 | A * | 12/1932 | Claus | 410/151 |
| 2,583,613 | A * | 1/1952 | Talbott | 49/465 |
| 3,477,679 | A * | 11/1969 | Lovitz | 248/213.2 |
| 4,893,736 | A | 1/1990 | Naig | |
| 5,595,260 | A | 1/1997 | Jalla | |
| 5,711,397 | A * | 1/1998 | Flora et al. | 182/3 |
| 5,758,743 | A * | 6/1998 | Coyle et al. | 182/45 |
| 6,092,623 | A * | 7/2000 | Collavino | 182/3 |
| 6,233,877 | B1 * | 5/2001 | Monroe | 52/37 |
| 6,491,135 | B2 * | 12/2002 | Lee | 182/3 |
| 6,962,234 | B1 * | 11/2005 | Reeves | 182/36 |
| 2002/0148680 | A1 * | 10/2002 | Lee | 182/3 |
| 2003/0159882 | A1 | 8/2003 | Franckewich, Jr. | |
| 2007/0163834 | A1 * | 7/2007 | Casebolt | 182/3 |

* cited by examiner

*Primary Examiner* — Katherine Mitchell
*Assistant Examiner* — Johnnie A Shablack
(74) *Attorney, Agent, or Firm* — Erickson, Kernell, Derusseau & Kleypas, LLC

(57) ABSTRACT

An anchor for securing a safety line to a container having an opening defined by an upstanding rim comprises a bar which is longer than the opening is wide. A pair of hooks are connected to the anchor bar by hook mounts. The hooks open downward toward ends of the anchor bar such that the rim of the access opening may be secured between each hook and an associated end of the anchor bar. A mounting tab is connected to an end of each hook below a hook bend. A safety line connector may be connected to either tab through a hole formed therein. The mounting tabs project outward to permit connection of a safety line thereto even when the access opening is covered. A third mounting tab, to which a safety line connector may be connected, is pivotally secured around the anchor bar.

15 Claims, 2 Drawing Sheets

SAFETY LINE ANCHOR

BACKGROUND OF THE INVENTION

This invention relates to apparatus for securing safety lines tethered to workers while performing maintenance or repair.

It is known to use anchors to provide a secure connection of a worker's safety line to a structure on which the worker is performing work. U.S. Pat. No. 1,275,053 to Leiding, for example, discloses a bar type anchor which can be secured across the frame of a window through which a worker passes while washing the window. A safety line or lanyard is connected at one end to the anchor and at the other end to the worker. U.S. Pat. No. 6,233,877 to Monroe, discloses another bar type anchor which is secured across a door frame.

These prior art systems generally work by engaging and pressing outward against an inner surface of the frame forming the opening through which a worker or safety line is to pass and then extending the anchor or securement structure behind the frame on the side of the frame opposite of the side on which the worker will be performing work. In such an orientation, the anchor cannot be pulled through the opening so that the worker, tethered to the anchor, can safely perform the required work.

Railroad hopper cars present unique problems for securing a worker performing maintenance on the hopper car. Hopper cars for storing grain or other granular material, typically have two elongate openings across the top through which the hopper is filled. Lids or covers for the openings are provided for covering the openings during transport. The bottom walls of the hopper car slope downward and inward to allow the contents to flow to one of a plurality of outlet gates in the bottom of the hopper car through which the contents of the hopper car are discharged.

To repair or clean the interior of a hopper car, a worker will access the interior through one of the openings. The sloping walls of the hopper car make it difficult for the worker to find a surface on which it is easy to stand. It is also frequently necessary for the worker to work on the exterior of the hopper car and because of the height of the hopper cars, it is preferable, that such a worker be connected by a safety harness to an anchor. Prior art anchors have been found to be inadequate, because they are only designed for securing a worker on one side of an opening. Moreover, known prior art systems are not designed to allow the worker to work on either side of an opening across which the anchor is secured, when the opening is covered.

There remains a need for an anchor for safety lines that is particularly well adapted for use with railroad hopper cars. In particular, there is a need for such an anchor which can be used to safely connect a worker to the hopper car while working either inside or outside of the hopper car and even when the opening to the hopper is covered.

SUMMARY OF THE INVENTION

A safety line anchor is disclosed for securing a safety line to a container having an access opening defined by an upstanding rim. The anchor is particularly well adapted for use with railroad hopper cars. The anchor comprises an anchor bar having first and second ends and a length which is longer than a width of the opening. First and second downwardly opening hooks are connected to the anchor bar. The hooks are sized to engage opposed sections of the rim with the first and second ends of the anchor bar extending below the opposed sections of the rim to which the hooks are connected.

Each hook is attached to the anchor bar by a hook mount. At least one of the hook mounts is slidably mounted on the anchor bar and selectively securable in one of at least two different positions along the length of the anchor bar. The hooks are connected to the hook mounts by means to permit adjustment of the spacing between the hook bend and the anchor bar to accommodate different sized rims of the container to which the anchor is to be secured.

Safety line mounting tabs are formed on the distal end of each hook below the peak of the hook bend. A mounting hole is formed in each mounting tab and sized to permit connection of a safety line connector to the mounting tab. The mounting tab projects outward from the end of the hook. A cover for the opening in the container or hopper car may be closed over the access opening with the anchor in place and the mounting tabs projecting below and beyond a lower edge of the cover. A worker may thereby connect a safety line connector to either mounting tab when the cover is in the closed position over the access opening.

A third mounting tab or mounting member is pivotally mounted on the anchor bar near its middle. The pivotal mounting member includes a ring-like portion to which a safety line connector may be connected. A worker typically connects a safety line to the pivotal mounting member when working within the container.

DETAILED DESCRIPTION

Figure 1:
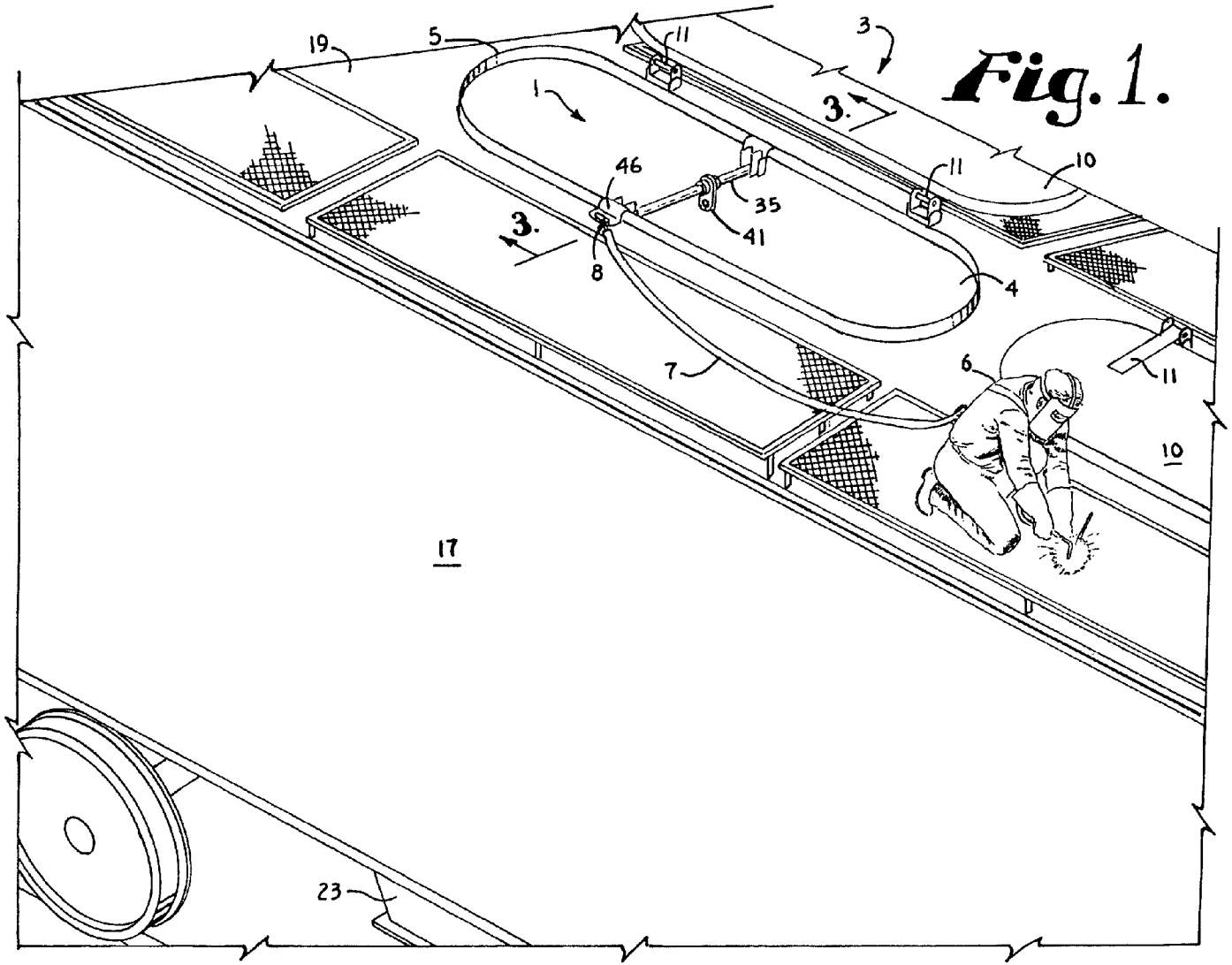
FIG. 1 is a perspective view of a hopper car having a safety line anchor secured across an opening to a hopper formed in the hopper car and showing a worker connected to the anchor bar by a lanyard connected to a safety harness on the worker.
Figure 2:
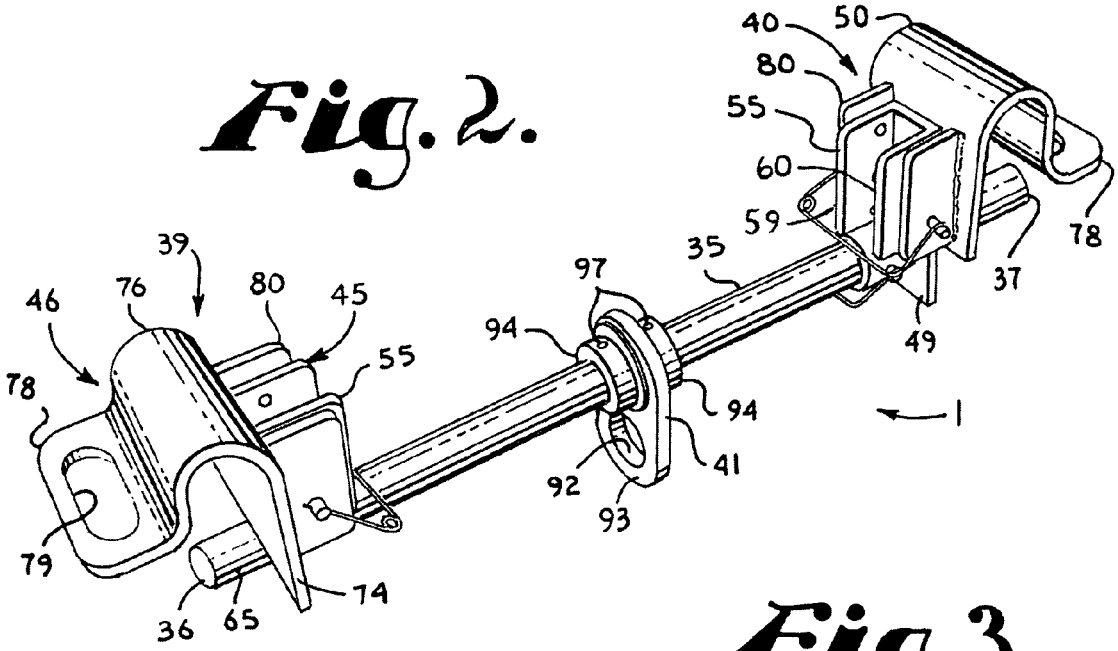
FIG. 2 is a perspective view of the safety line anchor.

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 refers to a safety line anchor for use in association with a vessel or container 3 with an access opening 4 defined by an upstanding rim 5. A worker wearing a safety harness 6 may be connected to the anchor 1 by a safety line or lanyard 7 with a mechanical connector 8 secured at a distal end of the lanyard 7. Mechanical connectors used may include carabiners, latching hooks or the like.

The container 3 shown, is a covered railroad hopper car with a pair of access openings 4 formed therein in end to end alignment. A cover or lid 10 is provided for each access opening 4 and fits over and around the associated upstanding rim 5. Each cover 10 is mounted on a pair of hinges 11 and is held closed by a latch assembly (not shown).

Figure 3:
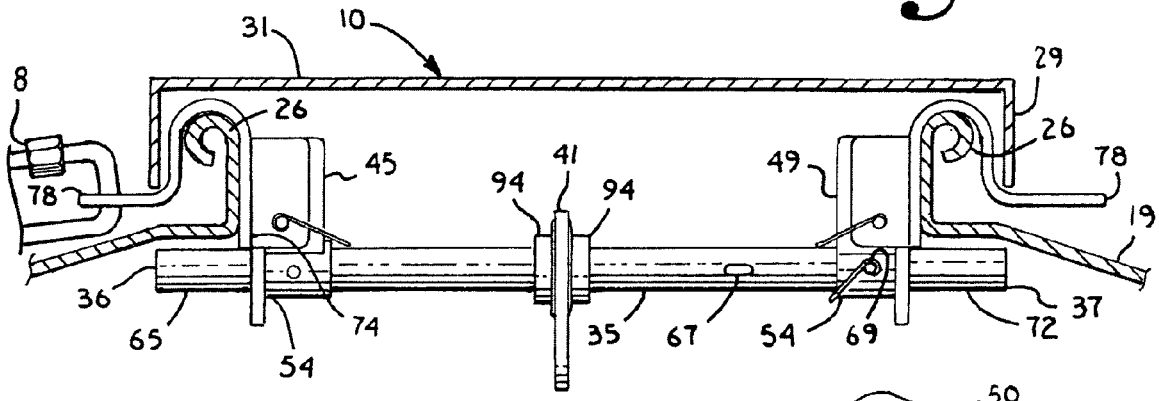
FIG. 3 is an enlarged and fragmentary cross-sectional view taken along line 3-3 of FIG. 1.
Figure 4:
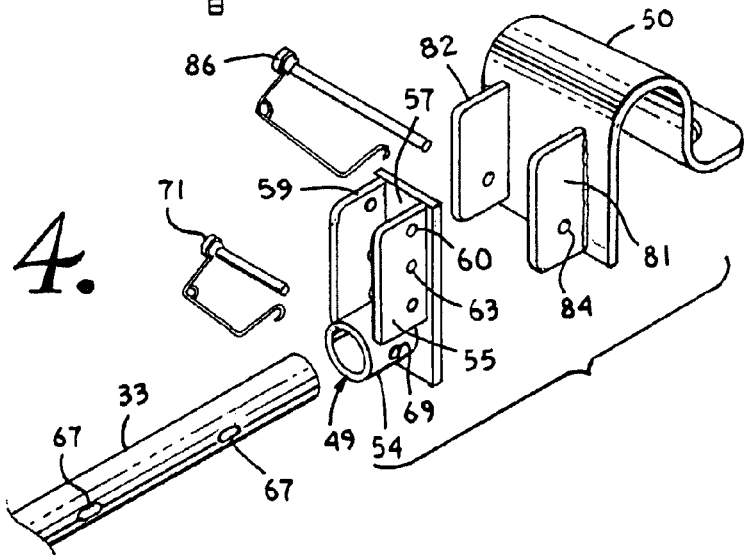
FIG. 4 is an exploded and fragmentary perspective view of the safety line anchor.

Each hopper car 3 typically includes multiple hoppers formed by sidewalls 17, a roof 19 and a sloped floor, sloping downwardly and inwardly to a discharge gate 23. The access openings 4 are formed in the roof 19 with each rim 5 projecting upward from the roof 19 around the periphery of the corresponding access opening 4. Each rim 5 is typically formed from sheet metal projecting vertically upward several inches, with the end rolled outward and downward to form a rolled edge 26 as best seen in FIG. 3. Each cover 10 typically includes a peripheral sidewall 29 and a top panel 31. The sidewall 29 is formed slightly wider and taller than the rim 5 so that the rim 5 is completely received within the access opening cover 10.

The anchor 1 comprises an elongate anchor bar 35 having first and second ends 36 and 37 with first and second hook assemblies 39 and 40 connected to the anchor bar 35 toward the ends 36 and 37, and a safety line attachment member or swivel mount 41 connected to the anchor bar 35 between the hook assemblies 39 and 40. Each hook assembly comprises a hook mount or base and a hook. More specifically, first hook assembly 39 comprises first hook mount 45 and a first hook 46 and the second hook assembly 40 comprises a second hook mount 49 and a second hook 50.

Each hook mount 45 and 49 comprises a sleeve 54 extending around the anchor bar 35 with a mounting frame 55 secured to and projecting outward from the sleeve 54. Each mounting frame 55 is formed from a face plate 57 welded to an outer end of the sleeve 54 with a hole extending through the face plate 57 in axial alignment with the bore through sleeve 54. Side plates 59 and 60 are welded to the face plate 57 and sleeve 54. The side plates 59 and 60 extend above the sleeve 54 and inwardly relative to the face plate 57 in spaced, parallel relationship. A plurality of pin receiving holes 63 are formed in each side plate 59 and 60 in vertically spaced alignment. The holes 63 in side plate 59 are aligned with the holes 63 in side plate 60. Sleeve 54 of the first hook mount 45 preferably is welded to the anchor bar 35 with the mounting frame 55 extending in what may be referred to as a vertical orientation. The first hook mount 45 is welded or otherwise secured to the anchor bar 35 in inwardly spaced relation from the first end 36 thereof several inches to form a first stub end 65.

The second hook mount 49 is slidably mounted on anchor bar 35 rather than being welded thereto. At least two ovate bores 67 are formed in the anchor bar 35 in spaced relation from the second end 37 thereof. A pin receiving bore 69 extends through the sleeve 54 of the second hook mount 49. A locking pin 71 is selectively inserted in a pin receiving bore 69 through sleeve 54 aligned with a selected ovate bore 67 in the bar 35 to generally fix the axial position of the second hook mount 49 to bar 35. The embodiment shown has two ovate bores 67 formed therein because there are two standard widths for hopper car access openings 4. Once the position of the second hook mount 49 is fixed, the portion of the anchor bar 35 extending outward therefrom may be referred to as the second stub end 72.

It is to be understood that additional bores 67 could be utilized and the length of the bar modified to accommodate different applications or sizes of openings in a vessel. Because the bores 67 through bar 35 are ovate, and locking pin 71 is cylindrical, the second mount 49 will slide axially a small distance relative to the anchor bar 35 when secured thereto by locking pin 71. Allowing a small amount of movement of the second hook mount 49 relative to the anchor bar 35, when connected thereto by pin 71, accommodates imperfections or slight variations in the dimensions of the access opening 4 to which the anchor 1 is to be attached.

First and second hooks 46 and 50 each include a shank or shank plate 74, a hook bend 76, a safety line mounting tab 78 and a clevis 80. The hook bend 76 is formed at an upper end of the shank plate 74 and curves or opens downward and outward relative to the shank plate 74 when the hook 46 or 50 is mounted to the hook mount 45 or 49 with the hook bend 76 curving back toward said anchor bar 35. The safety line mounting tab 78 projects outward from a distal end of the hook bend 76. A hole 79 is formed in each safety line mounting tab 78. The hole 79 is sized to receive a safety line connector 8 for connecting the associated lanyard 7 to the tab 78 and the associated hook 46 or 50. The tab 78 extends outward from a lower end of the hook bend 76 and is spaced below an upper end or peak of the hook bend 76 to allow sidewalls of the cover 10 to extend at least partially over and around the upstanding rim 5 and the hook 46 or 50 mounted thereon. The tab 78 is also spaced above a lower end of the shank plate 74 a distance sufficient to allow a leg or portion of safety line connector 8 to extend below the tab 78 and above the roof 19 of the hopper car or vessel 3 to which the anchor 1 is attached.

In the embodiment shown, the mounting tabs 78 are generally formed as extensions of the hook bend 76. It is foreseen that the mounting tabs 78 could comprise separately formed rings or loops connected to the distal end of each hook 46 and 50. It is also to be understood that only one of the hooks 46 or 50 might have a mounting tab formed on or connected thereto.

Each clevis 80 comprises a pair of clevis plates 81 and 82 projecting inwardly relative to the shank plate 74 in parallel and spaced relation. The clevis plates 81 and 82 are spaced apart just slightly wider than the side plates 59 and 60 of the hook mount mounting frames 55. One set of aligned holes 84 are formed in the clevis plates 81 and 82 near a lower end thereof. Each hook 46 and 50 is connected to a corresponding hook mount 45 and 49 by positioning the clevis plates 81 and 82 of the hook over the corresponding hook mount mounting frame 55, aligning holes 84 in clevis plates 81 and 82 with a selected pair of aligned pin receiving holes 63 in the mounting frame side plates 59 and 60, and then inserting a locking pin 86 in the aligned holes 84 and 63.

Swivel mount 41 is pivotally mounted to the anchor bar 35 between the hook assemblies 39 and 40 and preferably near or at the center of the anchor bar 35. Swivel mount 41 is formed from an ovate metal plate with two holes (only one shown) bored therein. Anchor bar 35 extends through a first hole and a second hole 92 forms a ring to which the connector 8 for a safety line 7 may be attached. The portion of the swivel mount 41 in which the second hole is formed may also be referred to as a mounting tab 93.

The swivel mount 41 is held in place on the anchor bar 35 and prevented from sliding laterally by a pair of collars 94 mounted to the anchor bar 35 on each side of swivel mount 41. Each collar 94 may be connected to the anchor bar 35 by a set screw 97.

The anchor 1 is adapted to be mounted on the upstanding rim 5 extending around the access opening 4 of a hopper car or other vessel 3 with the anchor bar 35 extending across the width of the access opening 4 with the stub ends 65 and 72 of the anchor bar 35 extending below the hopper car roof 19. To install the anchor 1, the user initially removes the hooks 46 and 50 from the respective hook mounts 45 and 49 and secures the second hook mount 49 to the anchor bar 35 in a spacing relative to the first hook mount 45 corresponding to the width of the access opening 4.

The first and second hooks 46 and 50 may then be positioned or set on the upstanding rim 5 on opposite sides of the access opening 4. The hook bend 76 extends over the curved portion of the rim 5, the shank plate 74 abuts or rests against a vertical wall of the rim 5 and the mounting tab 78 projects outward and away from the rim 5 and access opening 4.

The anchor bar 35 is then inserted through the access opening 4 in the hopper car roof 19 and rotated so that the stub ends 65 and 72 extend below the roof 19 on opposite sides of the access opening 4 with the hook mounts 45 and 49 directed upwards. The mounting frame 55 of each hook mount 45 and 49 is positioned between the clevis 80 of the corresponding hooks 46 and 50 and drawn upward to align the pin receiving holes 84 in the clevis plates 81 and 82 with a selected set of holes 63 in the side plates 59 and 60 of the mounting frame 55. A locking pin 86 is then inserted into aligned sets of holes 84 and 63 to secure each hook 46 or 50 to the corresponding hook mount 45 or 49. In connecting the hooks 46 and 50 to the hook mounts 45 and 49 respectively, the set of holes 63 selected for alignment with holes 84 preferably is the set of holes which minimizes the spacing between the hook bend 76 and associated anchor bar stub end 65 or 72 while receiving or accommodating the upstanding rim 5 and roof 19 therebetween.

With the anchor 1 connected to the upstanding rim 5, a worker can connect a safety line connector 8 to the swivel mount 41. The worker can then descend into the vessel or container 3 with a safety line 7 connected between the connector 8 and a harness 6 worn by the worker. The swivel mount 41 pivots about anchor bar 35 as the worker moves around within the vessel 3. The hooks 46 and 50 secure the anchor bar 35 to the upstanding rim and prevent the anchor assembly 1 from being pulled into the vessel 3.

If the worker needs to work on the roof 19 or side of the hopper car or vessel 3, the worker can connect the safety line connector 8 to the mounting tab 78 on either the first or second hook 46 or 50. The mounting tabs 78 project outward from the hook bend 76 of each hook 46 and 50 far enough to extend past the outer periphery of the cover 10 when it is positioned over and around the upstanding rim 5, as generally shown in FIG. 3. The worker is thereby able to attach a safety line connector 8 to either mounting tab 78 even when the access opening 4 and the anchor bar 35 is covered by cover 10. It is to be understood that for safety purposes, the cover 10 to the access opening 4 is usually closed when a worker is working on the roof 19 of the hopper car 3 to avoid falling through the access opening 4. The cover 10 is shown open in FIG. 1 to show the positioning of the anchor 1 across the access opening 4.

The extension of the stub ends 65 and 72 below the roof 19 on either side of the access opening 4 prevents the anchor bar 35 from being pulled back through the access opening 4 when the worker is working outside of the vessel 3. The configuration of the anchor 1 so that the upstanding rim 5 is captured between the hook bend 76 of each hook 46 and 50 and the first and second stub ends 65 and 72 respectively of anchor bar 35 allows the worker, connected to the anchor 1, to safely work on either side of the access opening 4.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is as follows:

1. An anchor for securing a safety line to a container having an opening defined by a rim projecting upward from the container, said anchor comprising:

a) an anchor bar having first and second ends and a length which is longer than a width of said opening;

b) first and second downwardly and outwardly opening hooks connected to said anchor bar each of said hooks comprising a shank and a hook bend extending outward from and back toward said anchor bar and sized to engage opposed sections of the rim with said hook bend extending over said rim and said first and second ends of said anchor bar extending below the opposed sections of the rim.

2. The anchor as in claim 1 wherein each of said first and second hooks includes spacing adjustment means for adjusting the spacing between a bend of said hook and said anchor bar.

3. The anchor as in claim 1 wherein at least one of said first and second hooks is slidably securable to said anchor bar and selectively securable in one of at least two positions along the length of said anchor bar.

4. The anchor as in claim 1 further comprising a swivel mount pivotally secured around said anchor bar; said swivel mount having a mounting hole formed therein sized for connection of a safety line connector to said swivel mount through said mounting hole.

5. The anchor as in claim 1 wherein at least one of said hooks has a mounting tab formed on a portion extending outward from said hook bend and below a peak of said hook bend; said mounting tab having a hole formed therein and sized to allow securement of a safety line connector to said mounting tab and outward from the rim on which said hook is supported.

6. The anchor as in claim 5 wherein said mounting tab is spaced above a lower end of a shank of said hook such that when said hook engages said upstanding rim said tab is spaced above the container a distance sufficient to allow a safety line connector to be connected to the tab.

7. An anchor for securing a safety line to a container having an opening defined by an upstanding rim, said anchor comprising:

a) an anchor bar having first and second ends and a length which is longer than a width of said opening;

b) first and second hook mounts connected to said anchor bar;

c) first and second downwardly and outwardly opening hooks selectively securable to said first and second hook mounts respectively and sized to engage opposed sections of the rim with said first and second ends of said anchor bar extending below the opposed sections of the rim; each of said hooks selectively securable in variable spaced relation to said respective hook mount to permit adjustment of a spacing between a hook bend of each of said hooks and said anchor bar.

8. The anchor as in claim 7 further comprising a swivel mount pivotally secured around said anchor bar; said swivel mount having a mounting hole formed therein sized to allow connection of a safety line connector to said swivel mount through said mounting hole.

9. The anchor as in claim 7 wherein at least one of said first and second hook mounts is slidably secured to said anchor bar and selectively securable in at least two positions along the length of said anchor bar.

10. The anchor as in claim 9 wherein at least one of said hooks has a mounting tab connected to an end of said hook below said hook bend; said mounting tab having a hole formed therein sized to allow securement of a safety line connector to said mounting tab.

11. The anchor as in claim 10 wherein said mounting tab is spaced above a lower end of a shank of said hook such that when said hook engages said upstanding rim said tab is spaced above the roof of the container a distance sufficient to allow a safety line connector to be connected to the tab.

12. An anchor for securing a safety line to a container having an opening defined by an upstanding rim, said anchor comprising:

a) an anchor bar having first and second ends and a length which is longer than a width of said opening;

b) first and second hook mounts connected to said anchor bar;

c) first and second downwardly opening hooks selectively securable to said first and second hook mounts respectively and sized to engage opposed sections of the rim with said first and second ends of said anchor bar extending below the opposed sections of the rim; each of said hooks selectively securable in variable spaced relation to said respective hook mount to permit adjustment of a spacing between a hook bend of each of said hooks and said anchor bar d) first and second mounting tabs connected to ends of said first and second hooks respectively below said hook bend; each of said mounting tabs having a hole formed therein sized to allow connection of a safety line connector to said mounting tab through said hole; and e) a swivel mount pivotally secured around said anchor bar; said swivel mount having a mounting hole formed therein sized to allow connection of a safety line connector to said swivel mount through said mounting hole.

13. The anchor as in claim 12 wherein at least one of said first and second hook mounts is slidably secured to said anchor bar and selectively securable in at least two positions along the length of said anchor bar.

14. The anchor as in claim 12 wherein each of said mounting tabs is spaced above a lower end of a shank of said hook to which said mounting tab is connected such that when said hook engages said upstanding rim said tab is spaced above the roof of the container a distance sufficient to allow a safety line connector to be connected to the tab.

15. An anchor for securing a safety line to a container having an opening and an upwardly projecting rim extending around the periphery of the opening in the container, said anchor comprising:

a) an anchor bar having first and second ends and a length which is longer than a width of said opening;

b) first and second hooks, each connected to said anchor bar by a hook mount proximate said first and second ends of said anchor bar respectively, each of said hooks having a shank connected to said hook mount and a hook bend extending outward and downward from said shank and in spaced relation from said anchor bar such that said hook opens downward over said anchor bar and outward relative to said shank such that said first and second hooks are positionable in the opening of the container to hook over opposed sections of the upwardly projecting rim with said first and second ends of said anchor bar extending below the opposed sections of the upwardly projecting rim.

* * * * *